United States Patent [19]

Sugiyama

[11] 4,276,961

[45] Jul. 7, 1981

[54] MAST AND CARRIAGE ASSEMBLY

[75] Inventor: Jun-ichi Sugiyama, Philadelphia, Pa.

[73] Assignee: Eaton Corporation, Cleveland, Ohio

[21] Appl. No.: 19,689

[22] Filed: Mar. 12, 1979

[51] Int. Cl.[3] ..... B66B 9/20

[52] U.S. Cl. ..... 187/9 E; 414/631

[58] Field of Search ..... 187/9 R, 9 E, 95, 73; 254/189, 188; 414/629, 641, 645, 631

[56] References Cited

U.S. PATENT DOCUMENTS

| | | | |
|---|---|---|---|
| 2,906,373 | 9/1959 | Hastings, Jr. et al. | 187/9 E |
| 3,252,545 | 5/1966 | Quayle | 187/9 E |
| 3,338,335 | 8/1967 | McNeeley | 187/9 E |
| 3,433,325 | 3/1969 | McIntosh | 187/9 E |
| 3,876,039 | 4/1975 | Bushnell, Jr. | 187/9 E |

*Primary Examiner*—Robert J. Spar
*Assistant Examiner*—Kenneth Noland
*Attorney, Agent, or Firm*—R. J. McCloskey; F. M. Sajovec, Jr.

[57] ABSTRACT

A mast and carriage assembly for an industrial truck which includes a stationary upright assembly (12) a movable upright assembly (14) and a telescopic cylinder (18) which is suspended between the stationary upright assembly and a load carriage (16) by a system of reeved load chains (94). The cylinder and its extensible ram assembly (69) are guided for vertical movement relative to the upright assemblies, and stop members (100) mounted on the load carriage are engageable with guide members (80) associated with the ram assembly to limit vertical movement of the load carriage relative to the ram assembly.

8 Claims, 9 Drawing Figures

MAST AND CARRIAGE ASSEMBLY

This invention relates to mast structures for lift trucks, and more particularly to a two-stage mast structure providing full free lift and improved visibility through the mast.

A so-called simplex mast structure for a lift truck includes a stationary mast member, a movable mast member, and a simple hydraulic cylinder acting between them. Free lift of the load carriage is obtained by a reeved chain system acted on by a pulley structure which is attached to and extends with the extending member of the cylinder. In many prior art mast structures the cylinder in its retracted state must be essentially the same height as the stationary mast member in order to obtain full extension of the moveable mast, thus tending to restrict visibility through the mast.

U.S. Pat. No. 3,252,545 discloses a mast structure which includes a stationary primary mast member, a secondary movable mast member, and a telescopic cylinder acting between the primary and secondary mast member. The cylinder is not attached directly to either mast member, but is suspended on the load chain connected between the stationary mast member and the load carriage, and acts on the mast members through a system of latches while being guided for movement with respect to the stationary and movable mast members.

A desirable feature of the above patented structure is that the means employed to mount the lift cylinder permits the cylinder to be very compact, such that the cylinder does not extend the full height of the mast members in its retracted condition, thus providing excellent visibility through the mast.

Included in the above patented mast structure is a system of latches and stops which insure that proper sequencing of the mast and load carriage is maintained for the entire lift range of the mast.

The present invention provides an improvement to the above mast structure by means of simple stop members acting between the load carriage and a cylinder guide member which eliminate the need for the latch system of the above patent while providing full free lift and proper sequencing.

The mast structure of the present invention includes a stationary mast member, a movable mast member adapted for vertical movement relative to the stationary member, a telescopic lift cylinder suspended on chains fixed to the stationary mast member and to the load carriage and guided for vertical movement by guide means attached to the cylinder and inter-fitting with guide rails on the stationary and movable mast members, and stop means interconnecting the load carriage and the cylinder guide member.

Other objects and advantages of the invention will become apparent from the following description when taken in connection with the accompanying drawings, wherein.

Figure 1:
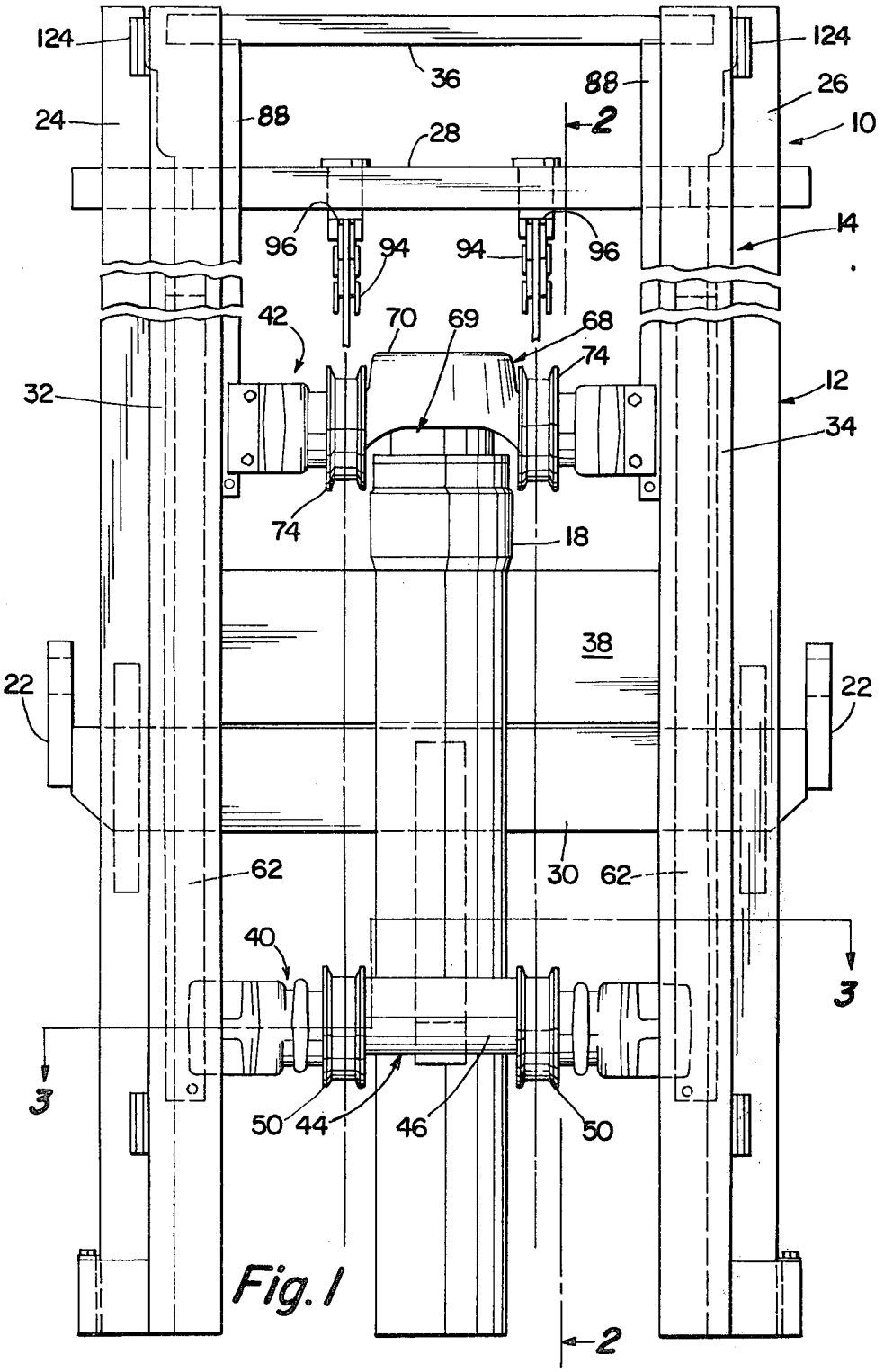
FIG. 1 is a front elevation view of a lift truck mast assembly incorporating the invention, with the load carriage removed for clarity.
Figure 2:
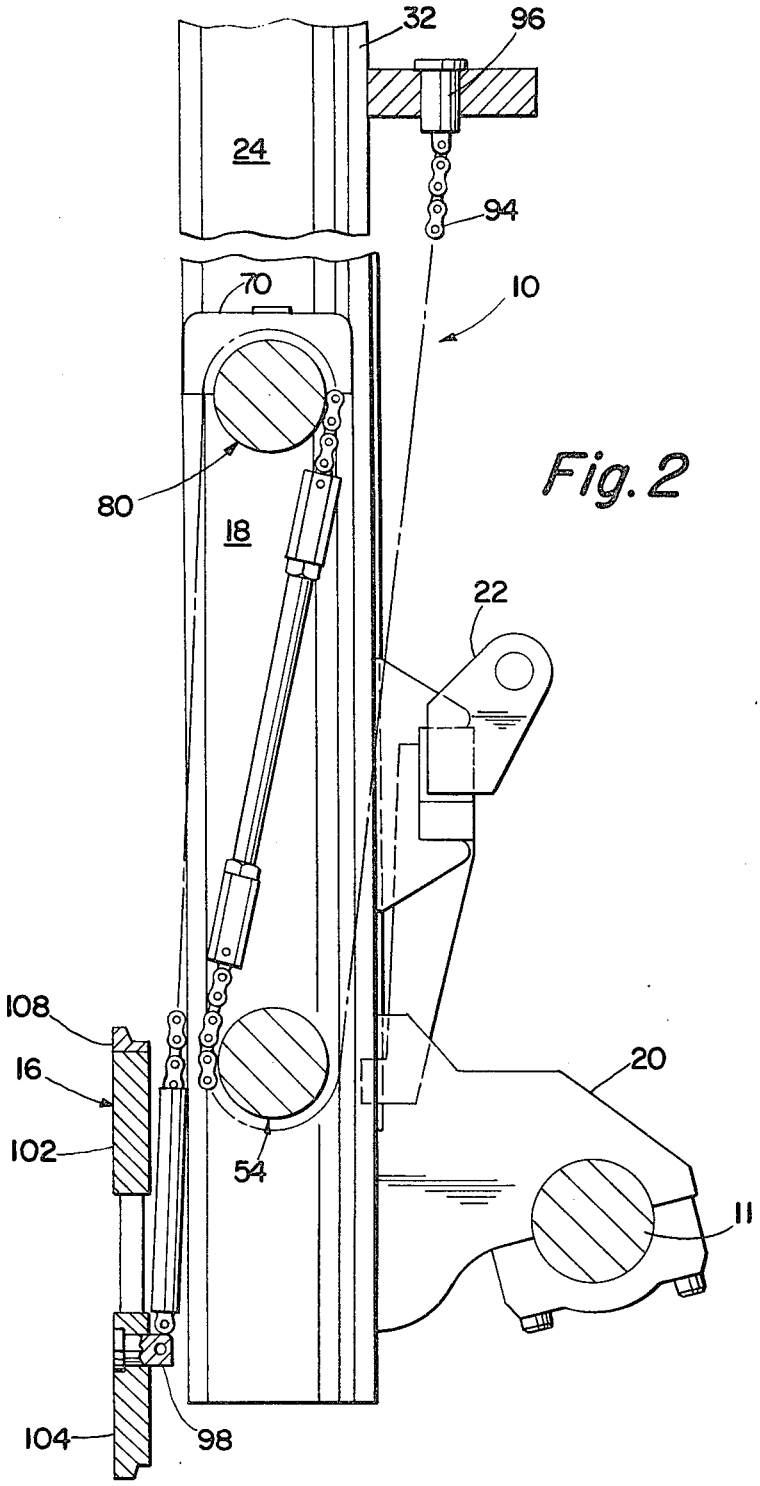
FIG. 2 is a sectional view taken along line 2—2 of FIG. 1.

Referring to FIGS. 1 and 2, there is illustrated a mast assembly 10 for attachment to an industrial truck. The mast assembly essentially comprises a stationary upright assembly 12, a movable upright assembly 14 mounted for vertical movement on the stationary upright assembly, a load carriage 16 mounted for vertical movement on the movable upright assembly, and a lift cylinder 18 adapted to raise and lower the movable upright assembly and the load carriage. The stationary and movable uprights are nested together and guided for relative vertical movement by a plurality of rollers 19 (FIGS. 3 and 4) in a conventional manner.

The mast assembly 10 is adapted for attachment to the front axles 11 of an industrial truck by means of trunnion brackets 20 (one of two shown in FIG. 2) welded or otherwise fixed to the stationary upright assembly 12. Mounting brackets 22 are welded or otherwise fixed to the stationary upright assembly 12 and are adapted for connection to one end of each of a pair of tilt cylinders, the other ends of which are attached to the truck frame. The mounting of the mast assembly and the attachment of the lift cylinders is conventional, and will not be described herein in further detail.

The stationary upright assembly 12 comprises a pair of spaced apart I-beam members 24, 26 tied together by an upper crossmember 28, and a lower crossmember 30, which are welded to the I-beam members.

The movable upright assembly 14 comprises a pair of spaced apart I-beam members 32, 34 tied together by an upper crossmember 36, and lower crossmember 38, which are welded to the I-beams. The stationary I-beams 24, 26 and the movable I-beams 32, 34 are nested together to form a telescoping mast assembly in accordance with the well-known practice in the industry.

The lift cylinder 18 is guided for vertical movement relative to the stationary and movable upright assemblies by means of a lower guide assembly 40 acting on the I-beam members 24 and 26 of the stationary upright assembly 12, and an upper guide assembly 42 acting on the I-beam members 32, 34 of the movable upright assembly 14.

Figure 4:
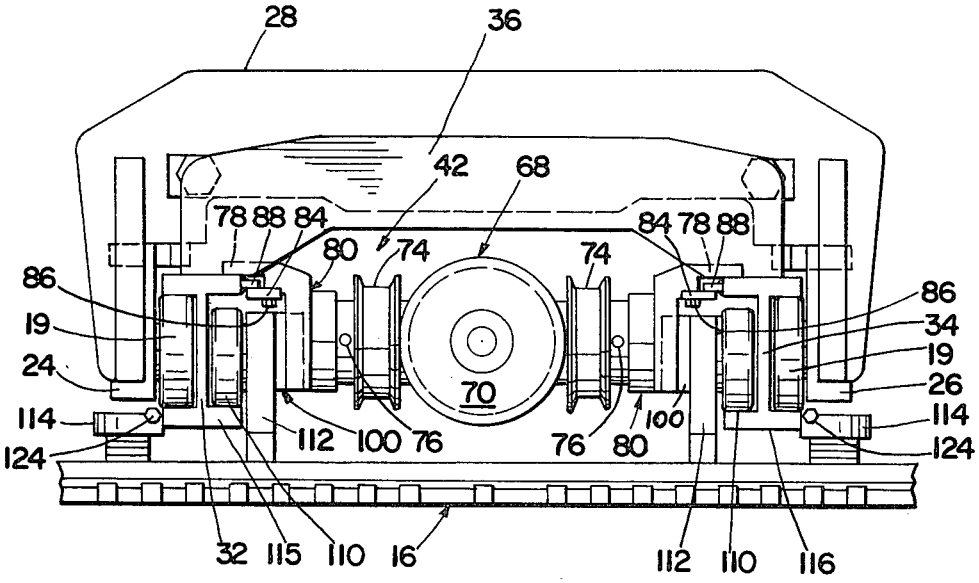
FIG. 4 is a plan view of the invention.
Figure 3:
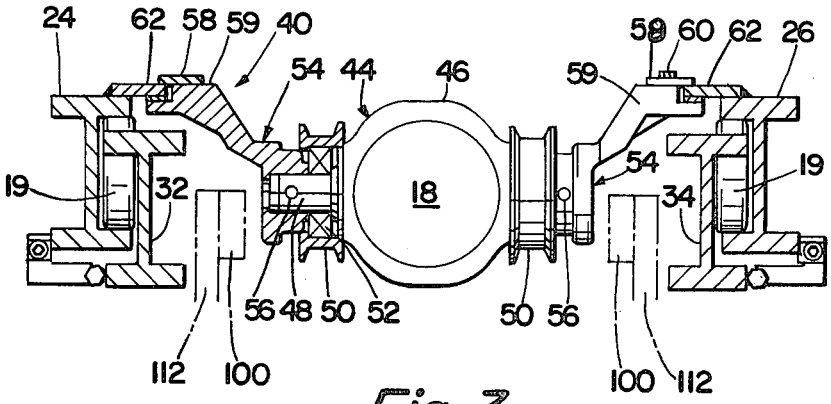
FIG. 3 is a sectional view taken along line 3—3 of FIG. 1.

Referring particularly to FIGS. 3 and 4, the lower guide assembly 40 is attached to a lower lift chain sheave support assembly 44 attached to the cylinder 18. The lower sheave support assembly 44 comprises a band 46, which is welded or otherwise fastened to the body of cylinder 18, and which has trunnion pins 48 extending from opposite sides thereof. Lift chain sheaves 50 are mounted for rotation on the trunnion pins on antifriction bearings 52.

The lower guide assembly 40 comprises a pair of guide members 54 which are received over the trunnion pins 48 and pinned thereto at 56, and retaining members 58 which are fastened to the rear faces of outwardly extending arms 59 of the guide members 54 by means of bolts 60. Elongated slide bars 62 are welded to the rear flanges of the I-beam members 24, 26, and are received between the retaining members 58 and the outwardly extending arms 59. The upper guide assembly 42 is part of an upper lift chain sheave support assembly 68 attached to the top of the extending ram assembly 69 of lift cylinder 18. The upper sheave support assembly 68 comprises a cap member 70 welded or otherwise fastened to an inner ram section 71 of the ram assembly 69, which has trunnion pins (not shown) extending from opposite sides thereof, similar to the lower sheave support assembly 44. Upper lift chain sheaves 74 are mounted for rotation on each trunnion pin on antifriction bearings (not shown).

The upper guide assembly 42 comprises guide members 80 which are received over the trunnion pins and pinned thereto at 76, and retaining members 84 which are fastened to the front faces of outwardly extending arms 78 of guide members 80 by means of bolts 86. Elongated slide bars 88 are welded to the rear flanges of the I-beam members 32, 34, and are received between the retaining members 84 and the outwardly extending arms 78.

In accordance with the invention, the lift cylinder 18 is not fastened directly to either upright assembly. Referring to FIGS. 1 and 2, a pair of lift chains 94 are attached to the upper crossmember 28 of the stationary upright assembly 12 at 96. The chains 94 extend downward, are reeved under the lower lift chain sheaves 50 and then extend upward and are reeved over the upper lift chain sheaves 74, and then extend downward again, and are attached to the load carriage 16 at 98. The cylinder 18 is thus suspended on the lift chains 94, and guided on the upright assemblies by the lower and upper guide assemblies 40 and 42.

Figure 5:
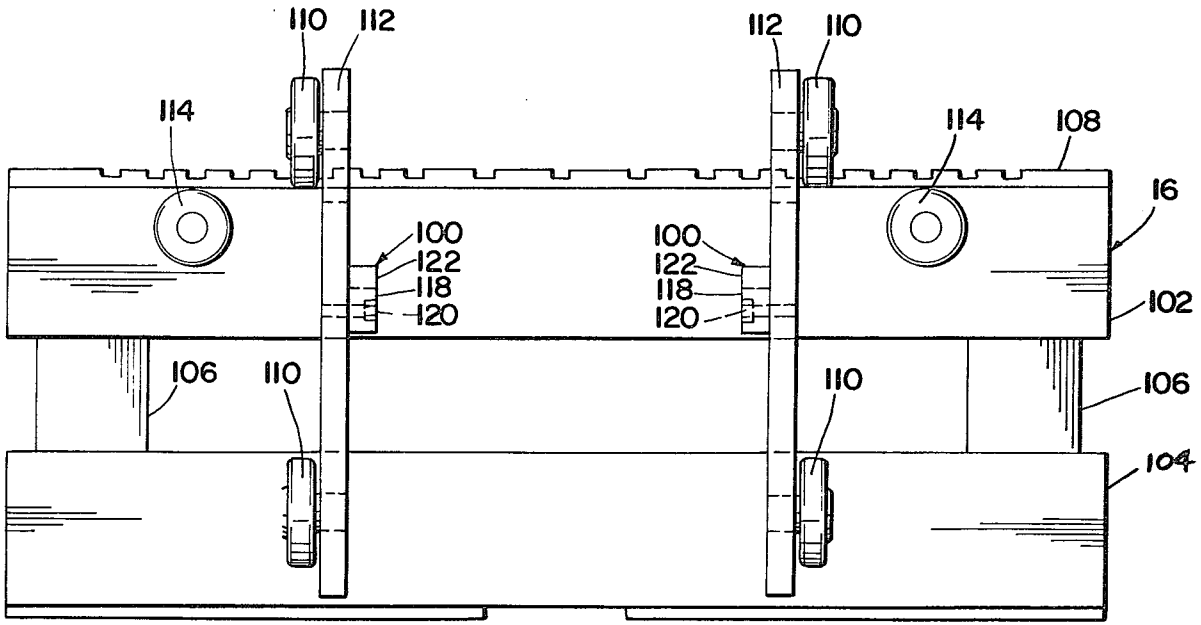
FIG. 5 is a rear elevation view of the load carriage of the invention.

To insure proper sequencing of the movable mast assembly and the load carriage, a pair of stops 100, which engage the upper guide members 80, are mounted on the load carriage 16. Referring to FIG. 5, the load carriage 16 comprises a pair of spaced apart horizontal backrest members 102 and 104 and a pair of vertical plate members 106 welded thereto. A notched plate 108 is welded or otherwise attached to or formed on the upper edge of the upper backrest member 102 to receive a pair of load forks 109 (see FIG. 8) in a conventional manner.

The load carriage 16 is guided on the movable upright assembly 14 by means of rollers 110 rotatably mounted on vertical support plates 112 attached to the backrest members, and received between the inner flanges of the mast members 32 and 34, as shown in FIG. 3. Side thrust rollers 114 are also rotatably mounted on the load carriage 16, and contact the outer edges of the front flanges 115, 116 of mast members 32 and 34 to further guide the load carriage.

In the illustrative embodiment, the stop members 100 each comprise a metal block member 118 attached to the vertical support plates 112 by means of bolts 120 and a resilient pad member 122 bolted or otherwise fastened to the block 118. The relative locations of the stops 100, the lower guide members 54, and the upper guide members 80 are such that the stops clear the lower guide members 54, as shown in broken line in FIG. 3 but contact the upper guide members 80, as shown in FIG. 4, as the load carriage is raised by the cylinder 18.

FIGS. 6, 7, 8 and 9 schematically illustrate the stages of extension of the mast assembly 10 and specifically the function of the stops 100.

Figures 6, 7, 8, 9:
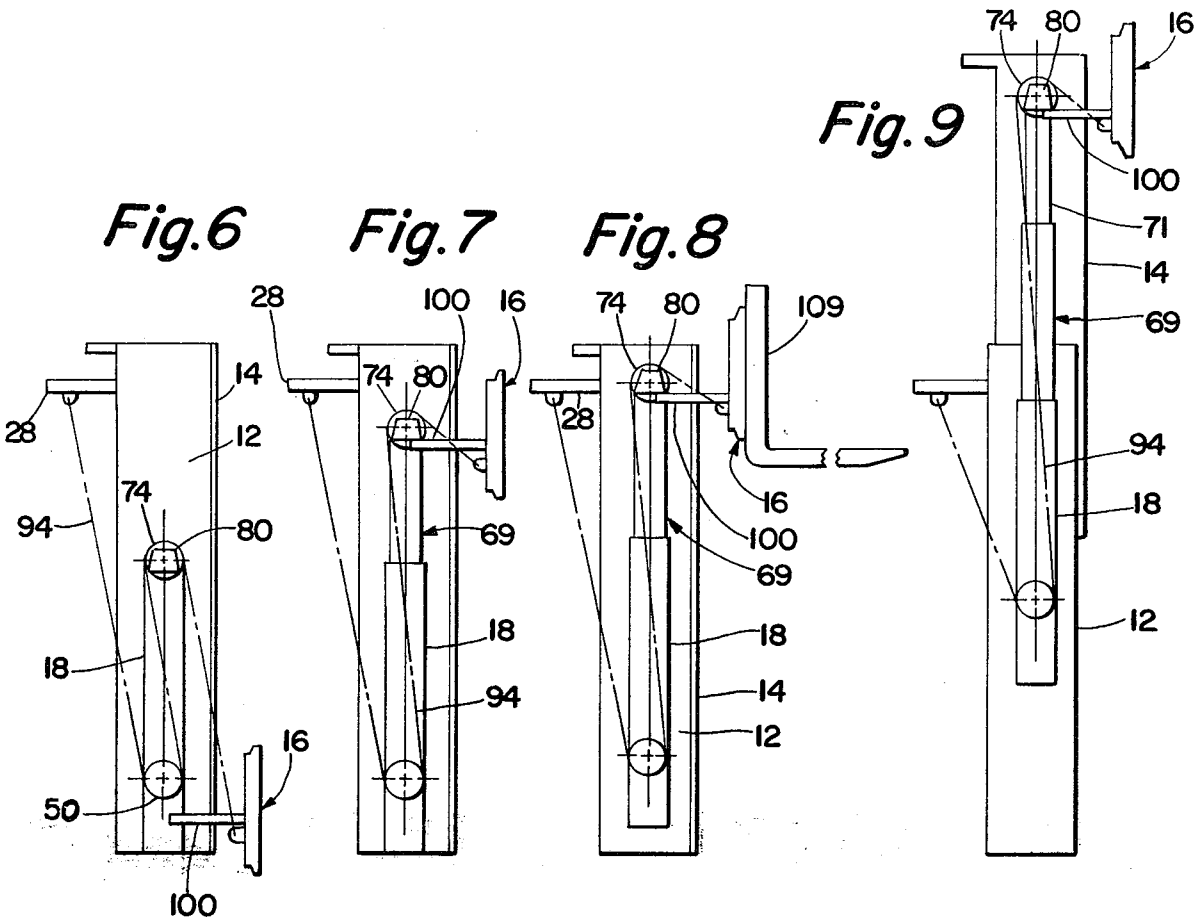
FIGS. 6, 7, 8 and 9 are schematic illustrations of four operative positions of the invention.

Referring to FIG. 6, the mast assembly is shown in its fully retracted position. The cylinder 18 is in its lowermost position suspended from the stationary upright assembly 12 by the chains 94, and the load carriage 16 is in its lowest position in relation to the movable upright assembly 14.

As shown in FIG. 7, when the cylinder 18 is pressurized, extending the ram assembly 69, the load carriage 16 moves first, due to the reeving of the chains 94. As the load carriage approaches the top of the movable upright 14, the stops 100 engage the upper guide member 80, thus stopping further upward movement of the load carriage 16 relative to the ram assembly 69. Since further upward movement of the load carriage relative to the ram assembly is stopped, further extension of the ram assembly causes the cylinder 18 to be drawn upward, as shown in FIGS. 8 and 9.

Additional extension of the ram assembly will bring the thrust rollers 114 of the load carriage into contact with stops 124 welded or otherwise fastened to the front flanges 115, 116 of the movable I-beam members 32, 34, thus effectively locking the load carriage to the movable upright assembly for further upward movement thereof. The position illustrated by FIG. 8 is the "full free lift" position of the mast assembly, wherein the load carriage is at its highest position relative to the movable upright assembly, while the movable upright assembly has not risen above its fully retracted position relative to the stationary upright assembly.

Further extension of the ram assembly 69 beyond the FIG. 8 position, extends a telescoping inner ram member 71 to which the upper sheave support assembly 68 is attached. As the cylinder is extended the inner ram member 71 is guided on the movable uprights by the upper guide assembly 42, and the cylinder body is guided on the stationary uprights by the lower guide assembly 40, as the cylinder 18 is drawn further upward by the reeved chains, until the full extension of the mast assembly is obtained, as shown in FIG. 9.

When the ram assembly 69 is retracted, the above sequence of events is reversed, the movable upright 14 moving downward to its fully retracted position as shown in FIG. 8, after which the load carriage 16 moves downward to its fully retracted position as shown in FIG. 6.

I claim:

1. In an industrial truck, a stationary upright assembly, a movable upright assembly mounted for vertical movement relative to said stationary upright assembly; a load carriage mounted for vertical movement relative to said movable upright assembly; a lift cylinder having a cylinder body and a vertically extendible ram assembly; means mounting said cylinder for bodily vertical movement relative to said stationary and movable upright assemblies; means interconnecting said stationary upright assembly, said cylinder and said load carriage whereby extension of said ram assembly lifts said load carriage relative to said upright assemblies; first stop means mounted on said load carriage and engageable with said ram assembly to limit upward movement of said load carriage relative to said ram assembly; second stop means attached to said movable upright assembly; and means mounted on said load carriage for engagement with said second stop means to cause said movable upright assembly to move upward when said ram assembly is extended beyond the point wherein said first stop means engages said ram assembly.

2. Apparatus as claimed in claim 1, including first guide means mounted on said ram assembly and slidingly engageable with said movable upright assembly for guided vertical movement relative thereto, said first stop means being engageable with said first guide means.

3. Apparatus as claimed in claim 2, including second guide means mounted on said cylinder body and slidingly engageable with said stationary upright assembly for guided vertical movement relative thereto, said second guide means being disposed on said cylinder body in position to clear said first stop means when said load carriage moves relative to said upright assemblies.

4. Apparatus as claimed in claim 3 in which said means interconnecting said stationary upright assemblies, said cylinder and said load carriage comprises a first pair of sheaves mounted for rotation on said ram assembly; a second pair of sheaves mounted for rotation on said cylinder body; and a pair of chains attached at one end to said stationary uprights, reeved under said second pair of sheaves, reeved over said first pair of sheaves, and attached to said load carriage.

5. Apparatus as claimed in claim 4 in which said first pair of sheaves are mounted on opposite sides of a cap member fixed to said ram assembly, said second pair of sheaves are mounted on opposite sides of a ring member fixed to said cylinder body, said first guide means comprises a first pair of guide arms attached to said cap member, and said second guide means comprises a second pair of guide arms attached to said ring member.

6. Apparatus as claimed in claim 5, including a first pair of opposed trunnion members attached to said cap member, a second pair of opposed trunnion members attached to said ring member, means rotatably mounting said first pair of sheaves on said first trunnion members, means rotatably mounting said second pair of sheaves on said second trunnion members, means mounting said first pair of guide arms on said first trunnion members, and means mounting said second pair of guide arms on said second trunnion members.

7. Apparatus as claimed in claim 1, in which said load carriage comprises vertical backrest means, and a pair of spaced apart vertically disposed support members attached to said backrest means, said first stop means comprising a block member attached to each of said support members.

8. Apparatus as claimed in claim 7, in which said means mounted on said load carriage for engagement with said second stop means comprises guide roller means attached to said backrest means and in rolling engagement with said movable upright assembly.

* * * * *